US006230640B1

(12) United States Patent
Nordstrom et al.

(10) Patent No.: US 6,230,640 B1
(45) Date of Patent: May 15, 2001

(54) CARGO CARRIER REFRIGERATION SYSTEM

(76) Inventors: Raimo-R. Nordstrom, P.O. Box 257, 00121 Helsinki; Hannu Nurminen, Valtolantie 105, 23100 Mynamaki, both of (FI)

( * ) Notice: Subject to any disclaimer, the term of this patent is extended or adjusted under 35 U.S.C. 154(b) by 0 days.

(21) Appl. No.: 09/296,295

(22) Filed: Apr. 22, 1999

(51) Int. Cl.[7] ..... B63B 25/00
(52) U.S. Cl. ..... 114/72; 62/240
(58) Field of Search ..... 62/240; 114/72, 114/74 A

(56) References Cited

U.S. PATENT DOCUMENTS 3,879,957 * 4/1975 Wilson et al. ..... 62/240
4,003,728 * 1/1977 Rath ..... 62/78
4,043,285 8/1977 Nordstrom .
4,294,185 10/1981 Nordstrom et al. .
4,422,304 * 12/1983 Kuttel ..... 62/78
5,183,305 2/1993 Nordstrom et al. .

* cited by examiner

*Primary Examiner*—Ed Swinehart
(74) *Attorney, Agent, or Firm*—Roylance, Abrams, Berdo & Goodman, L.L.P.

(57) ABSTRACT

A cargo carrier includes a hollow interior defining a cargo area. Thermal insulation is mounted in the body and surrounds the cargo area. Refrigeration units are located in refrigeration areas in the cargo area. A plurality of cargo containers are stacked within the cargo area and are spaced from the refrigeration units. The cargo containers support cargo and have a plurality of passageways around the cargo and through the containers between the outsides and insides of the containers. Cooling air is conveyed from the refrigeration units into the containers, around the cargo and from the containers back to the refrigeration units.

20 Claims, 4 Drawing Sheets

CARGO CARRIER REFRIGERATION SYSTEM

FIELD OF THE INVENTION

The present invention relates to a cargo carrier having an insulated cargo area housing refrigeration units and cargo containers. The cargo containers have passageways for conveying cooling air from the refrigeration units, about the cargo in the containers and back to the refrigeration units.

BACKGROUND OF THE INVENTION

Container ships with upper structures for loading and unloading cargo containers are disclosed in U.S. Pat. Nos. 4,043,285 to Nordstrom, U.S. Pat. No. 4,294,185 to Nordstrom et al, and U.S. Pat. No. 5,183,305 to Nordstrom et al, the subject matter of each of which is hereby incorporated by reference. These ships maximize cargo carrier capacity, minimize idle port time and provide a highly efficient system for loading and unloading the cargo. Automated cranes on ships guarantee fast turn around in ports saving manpower and time, particularly reducing or eliminating the need for manual labor in the ships' holds for loading and unloading the cargo. Additionally, large amounts of cargo can be stored in a secure manner in a minimum amount of time and with minimum labor requirements. Further, the loading and unloading operations can be carried out even in bad weather or high winds.

Although these Nordstrom container systems are highly effective for cargo that is not temperature sensitive, they have not been adapted for handling refrigerated cargo. Certain food cargo products must be maintained in a refrigerated state during transit to avoid damage or spoilage.

Conventional refrigerated ships intended for transporting breakbulk or palletized cargo have holds divided by decks two to three meters high, providing spaces with perforated deck grating. These spaces form air ducts under the cargo. Refrigerated air is blown into the ducts at the end of the hold or through side ducts. The refrigerated air ascends through the cargo and through the duct at the opposite end of the hold, and then returns to the refrigeration unit via spaces above the cargo. Two of these between deck spaces can be combined to form a common air space, although such combination risks incomplete refrigeration at the higher levels of the hold.

The loading and the unload of the cargo in these conventional refrigeration systems for cargo ships can be performed with onboard cranes and booms. Horizontal transport inside the hold and tight storing of the cargo to prevent shifting is accomplished with forklift trucks.

Another refrigeration system for container ships involves using refrigerated containers, each of which has its own independent refrigeration unit or machinery. These units can be used in any container ship as long as adequate electrical power from the ship is provided to each container for running its refrigeration unit. However, adequate ventilation must be provided in the cargo hold to dissipate the heat emitted by the refrigerated units. These independently refrigerated containers can be loaded using cranes, trailers, cassettes, forklift trucks and straddle carriers.

Some container ships have refrigeration units which supply refrigerated air through ducts. These ducts are coupled to containers which are thermally insulated. Suitable couplings are provided on the containers for conveying the inlet air into and exhaust air from the insulated containers.

Special ships for palletized cargo use a warehouse—type storage system. The pallets are loaded with a ship board stacker crane from the side of the ship, and are transported to special pallet rows. Refrigerated air is conveyed to these rows through ducts.

These conventional ship refrigeration systems have a number of problems. The systems are not adaptable to wide variety of different arrangements, without structural modification. Additionally, they are expensive and inefficient in the use of the particular containers and in the loading and unloading of the containers within the ships.

SUMMARY OF THE INVENTION

An object of the present invention is to provide a cargo carrier for refrigerated cargo which is easily adapted to a wide variety of uses.

Another object of the present invention is to provide a cargo carrier for refrigerated cargo which is simple and relatively inexpensive to construct, and is efficient in time and manpower requirements for loading and unloading.

Further object of the present invention is to provide a cargo carrier for refrigerated cargo which is lighter, less expensive and more efficient to operate, and uses cargo containers which are significantly lighter and cheaper than individually refrigerated containers.

The foregoing objects are basically obtained by a cargo carrier comprising a cargo body, refrigeration units and a plurality of cargo containers. The cargo body has a hollow interior defining a cargo area. Thermal insulation in the body surrounds the cargo area. The refrigeration units are located in refrigeration areas in the cargo area. The cargo containers are stacked within the cargo area and are spaced from the refrigeration units. These containers have cargo supported therein and have a plurality of passageways around the cargo. The passageways extend through the containers between the outside and inside of the containers to convey cooled air into the containers, around the cargo, and from the containers back to the refrigeration units.

By forming the cargo carrier in this manner, the carrier can be inexpensively formed and adaptable to a wide variety of uses. The thermal insulation mounted in the body frees the entire cargo area for efficient stacking of the cargo containers within the hold or cargo area. Separation of the refrigeration units from the cargo area avoids interference with the loading and unloading of the cargo. No separate connection of each container with a power supply is necessary, as would be required for individually refrigerated containers.

By having passageways located in and between the cargo containers for conveying the cooled air into the containers, around the cargo and then back to the refrigeration units, the need for built-in ducts in the cargo carrier or ship is eliminated. The elimination of ducts reduces the cost of the cargo carriers or ships, and allows them to be adapted to a wide variety of uses without rerouting or reforming the ducts. The arrangement of the present invention also allows for the use of simpler, less expensive and lighter cargo containers.

Other objects, advantages and salient features of the present invention will become apparent from the following detailed description, which, taken in conjunction with the annex drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
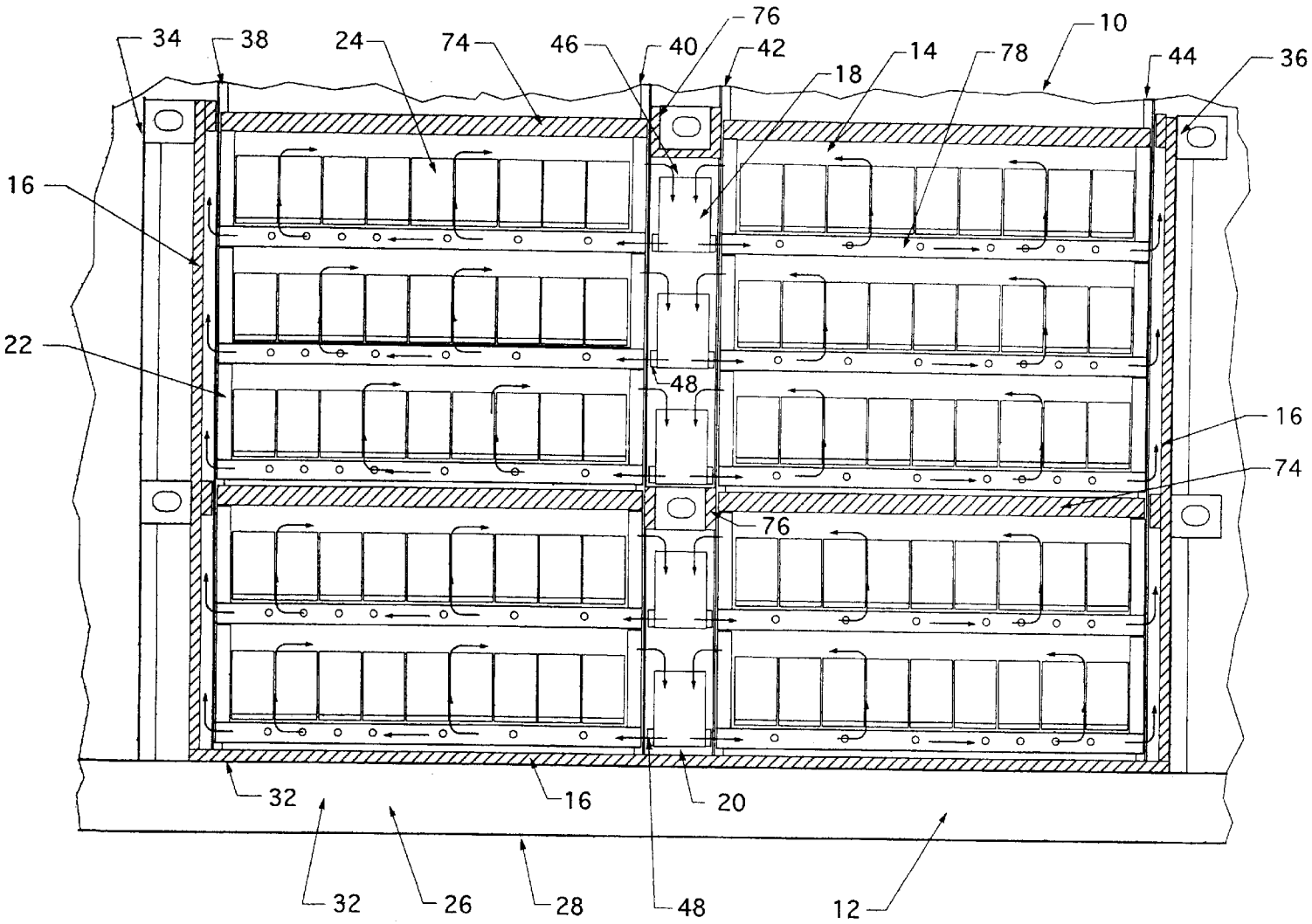
FIG. 1 is a partial, side elevational view in section diagrammatically illustrating a ship or a marine cargo carrier according to a first embodiment of the present invention.

Referring initially to FIG. 1, a marine cargo carrier or container ship 10 according to the first embodiment of the present invention comprises a carrier body 12 having a hollow interior defining a cargo area or hold 14. Thermal insulation 16 is located in the body and surrounds the cargo area. Refrigeration units 18 are located in refrigeration area 20 which are formed as part of cargo area 14. A plurality of cargo containers 22 are stacked within cargo area 14 and are spaced from the refrigeration units. The containers support cargo 24 therein and have a plurality of passageways around the cargo and through the containers. The passageways convey cooled air into the containers around the cargo and in the free space above the cargo back to the refrigeration units. If a pair of 20 ft containers are used in place of one 40 ft container, the air is conveyed through the double bottom of the first container to the second container.

In FIG. 1, a typical longitudinal section of the ship is illustrated. This section is repeated throughout the length of the ship to provide a plurality of cargo areas or holds.

The ship comprises a bottom 26 formed of a bottom shell 28 an inner bottom 32 and a vertical keel 32 between the bottom shell and the inner bottom. The fore and aft ends of the cargo area are defined by transverse bulk heads 34 and 36. The inner surfaces of the ship side shells, of transverse bulkheads 34 and 36 and of the inner bottom 32 are covered with the thermal insulation 16.

A plurality of container guide members 38, 40, 42 and 44 extend vertically within the cargo area. In the illustrated embodiment, two pairs facing guide members are longitudinally spaced within the cargo area. Each of the guides can be of the form disclosed in U.S. Pat. No. 4,294,185. These guides facilitate loading and unloading of the cargo within the hold, and retain the cargo in place during shipping to avoid movement during transport.

Guide members 38 and 40 define a first set of guide members for positioning a first stack of cargo containers. Guide member 42 and 44 form a second set of guide members for positioning a second, parallel stack of cargo containers. Thus, the guide members define storage cells in the cargo area, with the storage cells being separated by the refrigeration area 20.

Refrigeration units 18 are arranged in the refrigeration area in a vertical stack, with spaces between any adjacent pair of refrigeration units. Each of the refrigeration units can be removably mounted in the lateral spaces between cargo containers 22.

The refrigeration units includes inlets 46 and outlets 48. Inlets 46 receive cooling air from the cargo hold after it has passed through and cooled the cargo. The refrigeration outlets discharge cooled or cooling air, after being cooled by the refrigeration units, into suitable passageways formed by spaces between and conduits in the cargo containers for distribution around the cargo.

The internal structure of each refrigeration unit is conventional, and is not described in detail. Such units can be operated by electrical power supplied by the ship and can have centrally located compressors.

Figure 2:
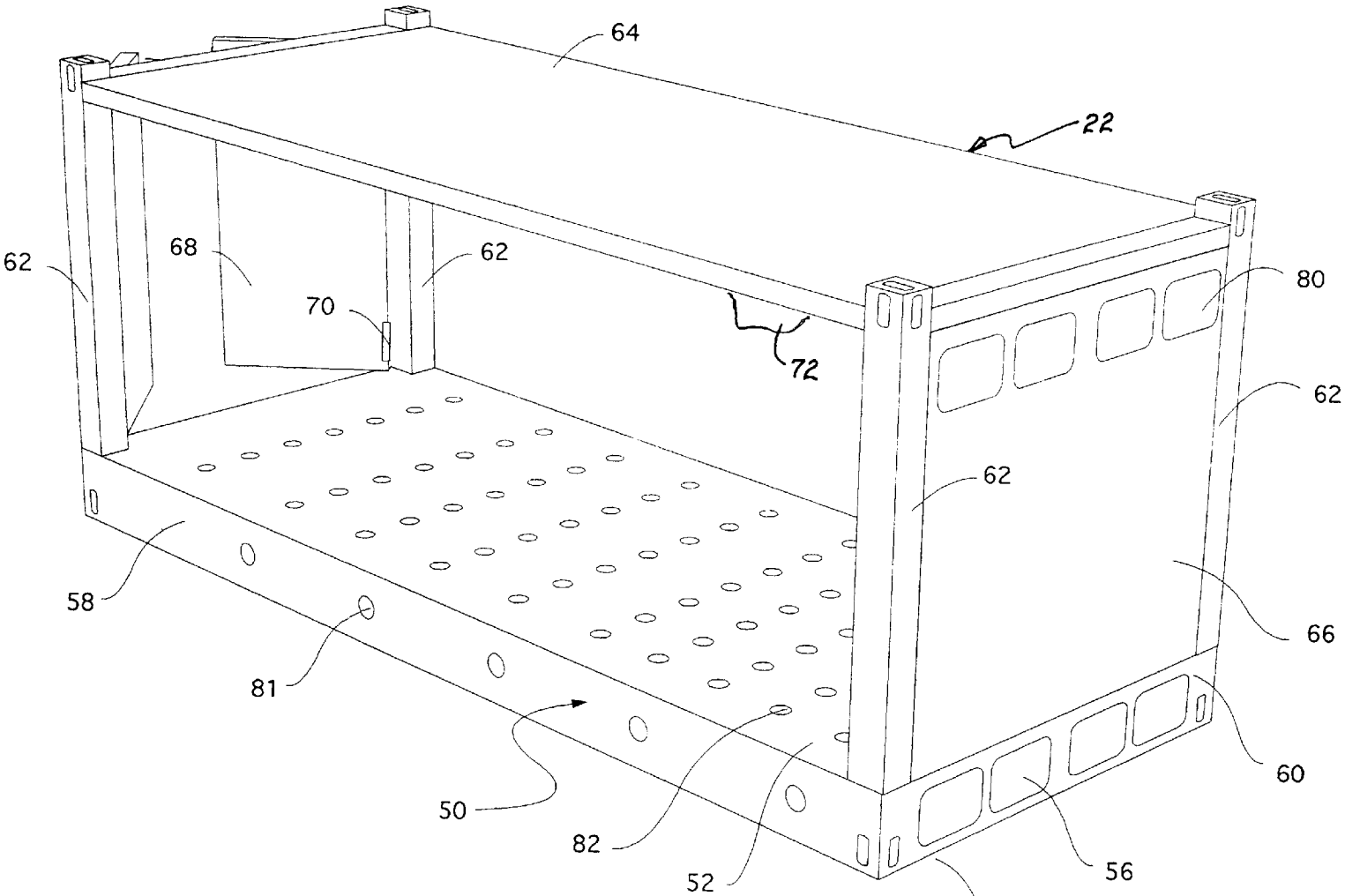
FIG. 2 is a perspective view of an open sided cargo container for the marine cargo carrier of FIG. 1.

FIG. 2 illustrates a cargo container 22 which can be used in the system of FIG. 1. The length and width are according to international container standards, but the height can vary according to cargo height. Each cargo container comprises a bottom 50 which is hollow between upper panel 52 and a lower panel 54. Openings 81 are formed in bottom sides 58. Openings 56 are formed in ends 60 of cargo container bottom 50. Openings 82 are formed in bottom upper panel 52. These openings are graphically illustrated in FIG. 2, and can be provided in any desired number and arrangement that does not adversely effect the structural integrity of bottom 50. Gratings can also be used in the upper panel 50 instead of a panel with openings. The vertical space between upper panel 52 and lower panel 54 provides air ducts 78 for conveying cooling air under the cargo.

Vertical members 62 extend upwardly from each of the four corners of bottom 50. The upper ends of the vertical members are coupled by an upper horizontal frame or member 64. The vertical members permit the cargo containers to be vertically stacked.

Appropriate corner pieces are provided at the corner ends of bottom 50 and upper member 64. These corner pieces are formed in a manner to be engaged with lifting systems of the type disclosed in U.S. Pat. No. 5,183,305.

The sides of the cargo containers can be open. The ends can be closed as shown by end member 66 and/or can have openable or collapsible door panels 68. The door panels are provided with hinges 70 for pivotally connecting them to the vertical members.

Figure 3:
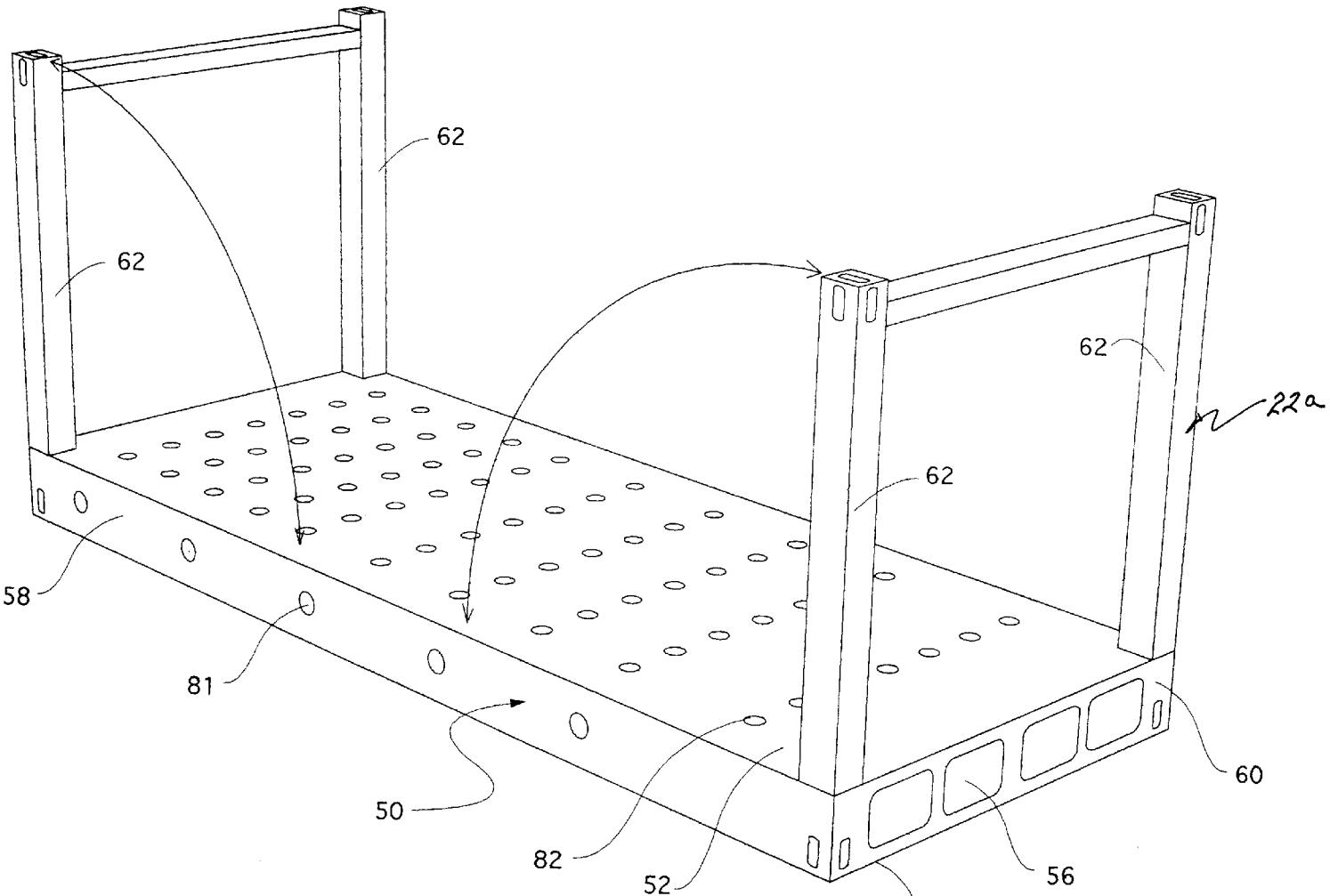
FIG. 3 is a perspective view of a flatrack type cargo container for the marine cargo carrier of FIG. 1.

FIG. 3 illustrates a flatrack type container 22*a* to be used in the system of FIG. 1. Each flatrack container comprises a bottom 50 which is similar to the container 22 in FIG. 2. The features of container 22*a* which are similar to container 22 are identified with like reference numbers. Vertical members 62 expand upwardly from each of the four corners of bottom 50. These vertical members can be pivotally collapsed, as indicated by the arcuate arrows. The vertical members permit the cargo flatracks to be vertically stacked. Since the upper member is omitted in container 22*a*, corner pieces are provided at the upper ends of vertical members 62.

Flexible sheets 72 which can be in the term of nets can be attached to the open sides of the container 22 and the tops of the flatrack container 22*a*.

Insulated covers 74 are removably mounted on selected containers 22 to vertically divide the cargo area or hold into different temperature zones. The insulated covers are removably mounted on the cargo containers, and engage and are laterally retained by guide members 38, 40, 42, and Additionally, insulated covers are removably mounted on the upper most cargo containers to close the tops of the cargo area. Additional insulation 76 can be provided in the refrigeration area to vertically separate the refrigeration area into the different temperature zones with insulated covers 74. The refrigeration units in different temperature zones can have different temperature settings to provide the different temperatures.

In operation, the cargo containers, loaded with cargo, are lowered into the cargo hold as described in the above cited Nordstrom patents. At suitable locations, insulated covers 74 are placed over selected cargo containers to form the desired temperature zones and to close the hold at its top.

With the containers and insulated covers in position refrigeration units are activated to emit cooling air as indicated by the arrows. The cooling air is emitted from outlets 48 into the cargo area, particularly into ducts 78 formed within the cargo container bottoms 50 and into the spaces between the cargo containers. The cooling air passes into openings 56 in bottom 50 and passes into the interior of the cargo containers through openings 81 and 82 or perforations in gratings, and about the cargo. The cooling air, after cooling the cargo, exits the cargo containers through holes 80 in the container of FIG. 2 or in the free space above the cargo in the flatrack of FIG. 3, and is conveyed back into refrigeration area 20. In refrigeration area 20, the return cooling air reenters the refrigeration units through refrigeration inlets 46 to repeat the cooling process.

Figure 4:
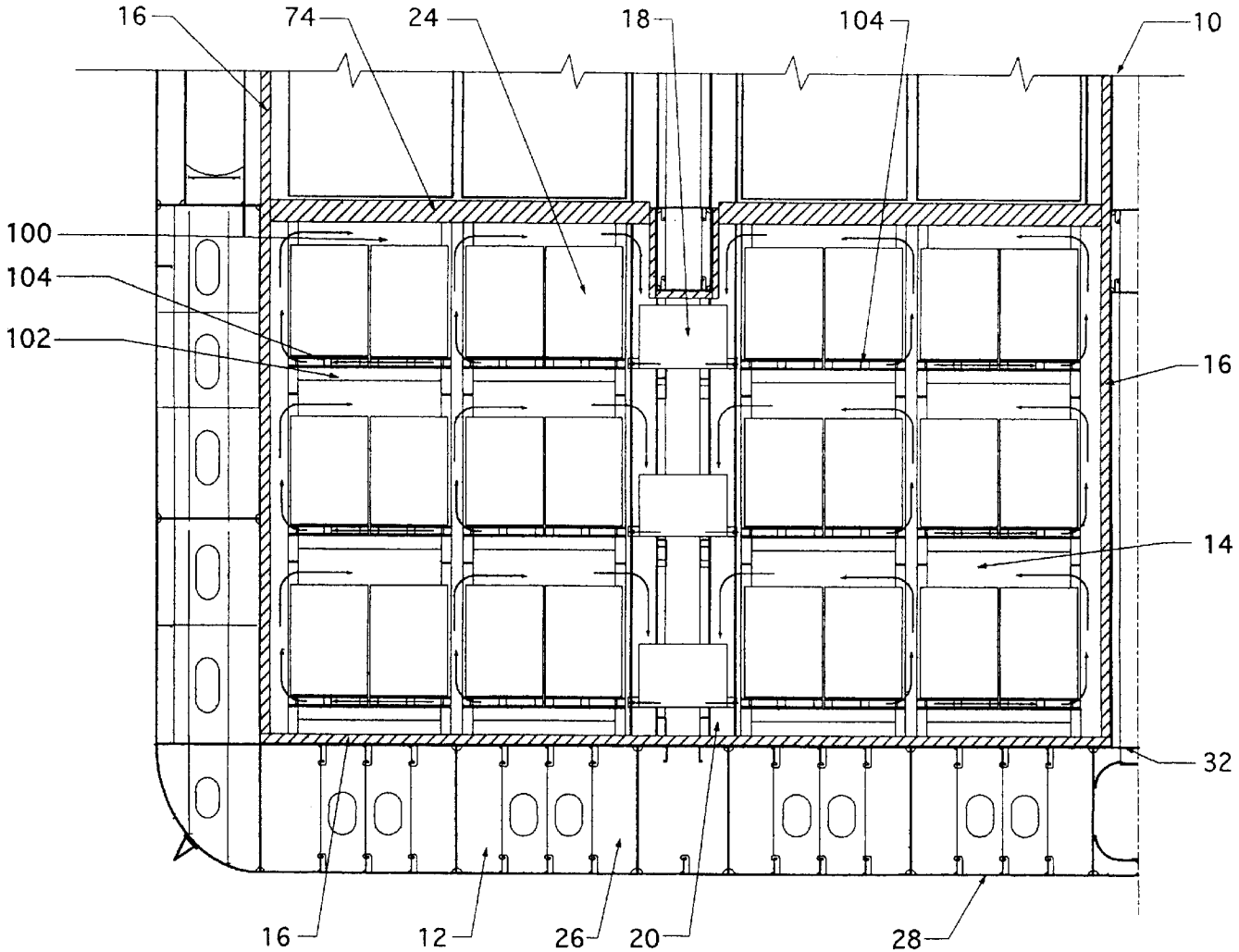
FIG. 4 is a partial, end elevational view in section diagrammatically illustrating a ship or marine cargo carrier according to a second embodiment of the present invention.

In FIG. 4, a second embodiment of the present invention is illustrated. The second embodiment differs from the first embodiment only in the configuration of the bottoms of the cargo containers. Otherwise, the various features are identical and are identified with like reference numbers.

Cargo containers 100 have a solid bottom 102 or hollow bottom without openings and air ducts passing therethrough. To convey cooling air under the cargo, conventional pallets 104 are placed between the cargo and the cargo container bottom. These pallets form air ducts passing underneath the cargo with openings in their upper surfaces to allow the cooling air to flow upwardly through the individual cargo units.

While various embodiments have been chosen to illustrate the invention, it will be understood by those skilled in the art that various changes and modifications can be made therein without departing from the scope of the invention as defined in the appended claims.

What is claimed is:

1. A cargo carrier, comprising:

a cargo body having a hollow interior defining a cargo area;

thermal insulation mounted in said body and surrounding said cargo area;

refrigeration units located in refrigeration areas in said cargo areas; and a plurality of cargo containers stacked within said cargo area and spaced from said refrigeration units, said containers having cargo supported therein and having a plurality of passageways around said cargo and around and through said containers between said refrigeration units and said containers and between outsides and insides thereof to convey cooled air from said refrigeration units to, around and into said containers, around said cargo and from said containers back to said refrigeration units.

2. A cargo carrier according to claim 1 wherein said cargo body comprises a plurality of guide members extending in said cargo area; and said cargo containers slidably engage said guide members during loading and unloading thereof in said cargo area, and retain said cargo containers in position during transit.

3. A cargo carrier according to claim 2 wherein said guide members define storage cells in said cargo area separated by lateral spaces, with each said cell receiving at least one vertical stack of said cargo containers; and said refrigeration units are located in said lateral spaces.

4. A cargo carrier according to claim 3 wherein said refrigeration units are vertically stacked and spaced in said lateral spaces.

5. A cargo carrier according to claim 3 wherein said refrigeration units are mounted in said lateral spaces.

6. A cargo carrier according to claim 1 wherein each of said cargo containers comprises corner pieces engageable with lifting systems.

7. A cargo carrier according to claim 1 wherein each of said cargo containers comprise vertically extending members allowing vertical stacking of said containers.

8. A cargo carrier according to claim 1 wherein sides of each of said cargo containers are open.

9. A cargo carrier according to claim 8 wherein flexible sheets are coupled to each of said cargo containers and removably cover said sides thereof.

10. A cargo carrier according to claim 1 wherein each of said cargo containers comprise collapsible end structures.

11. A cargo carrier according to claim 1 wherein each of said cargo containers comprises a bottom member having a bottom air duct for conveying cooling air under the cargo.

12. A cargo carrier according to claim 11 wherein each said bottom member comprises upper and lower vertically spaced horizontal members defining said air duct therebetween, and comprises openings in side and ends thereof and in said upper horizontal member.

13. A cargo carrier according to claim 1 wherein separate pallets, mounted on bottom members of said cargo containers, define air ducts for conveying cooling air under the cargo.

14. A cargo carrier according to claim 1 wherein said thermal insulation is coupled to bottoms, sides and transverse bulkheads defining said cargo area.

15. A cargo carrier according to claim 1 wherein said cargo area is vertically divided by insulated covers into different temperature zones.

16. A cargo carrier according to claim 15 wherein said insulated covers are removably mounted on selected ones of said cargo containers, and are laterally retained by guide members extending in said cargo area which slidably engage said cargo containers.

17. A cargo carrier according to claim 1 wherein insulated covers are removably mounted on upper most ones of said cargo containers to close tops of said cargo area, and are laterally retained by guide members extending in said cargo area which slidably engage said cargo containers.

18. A cargo ship, comprising:

a vessel body having a bottom, sides and transverse bulkheads defining cargo holds therein;

thermal insulation coupled to said bottom, sides and bulkheads;

a plurality of guide members extending in said cargo holds defining storage cells therein separated by lateral spaces;

refrigeration units vertically stacked in said lateral spaces; and a plurality of cargo containers stacked within said cargo holds in engagement with said guide members and spaced from said refrigeration units, said cargo containers including vertically extending members with corner pieces engagable with lifting devices and including bottoms with passageways conveying cooling air from said refrigeration units into said cargo containers, around cargo mounted therein and out of said cargo containers for return to said refrigeration units.

19. A cargo ship according to claim 18 wherein flexible sheets are coupled to each of said cargo containers and removably cover said sides thereof.

20. A cargo ship according to claim 18 wherein said cargo area is vertically divided by insulated covers into different temperature zones;

said insulated covers are removably mounted on selected ones of said cargo containers, and are laterally retained by said guide members; and insulated covers are removably mounted on upper most ones of said cargo containers to close tops of said cargo area, and are laterally retained by said guide members.

* * * * *